US005117463A

United States Patent [19]

Oyaba et al.

[11] Patent Number: 5,117,463

[45] Date of Patent: May 26, 1992

[54] SPEAKER SYSTEM HAVING DIRECTIVITY

[75] Inventors: Takashi Oyaba; Hideaki Morikawa; Yasuo Gan, all of Saitama; Naobumi Kanemaki, Tokyo, all of Japan

[73] Assignees: Pioneer Electronic Corporation; Nippon Telegraph and Telephone Corporation, both of Tokyo, Japan

[21] Appl. No.: 454,235

[22] Filed: Dec. 21, 1989

[30] Foreign Application Priority Data

Mar. 14, 1989 [JP] Japan ..... 1-59682

[51] Int. Cl.[5] ..... H04R 25/00; H04R 1/02; H04R 7/00; G10K 11/00

[52] U.S. Cl. ..... 381/158; 381/90; 181/159; 181/180

[58] Field of Search ..... 381/158, 88, 90, 188, 381/205; 181/146, 151, 154, 155, 199, 148, 150, 152, 153, 159, 175, 177, 180, 183, 192

[56] References Cited

U.S. PATENT DOCUMENTS

| | | | |
|---|---|---|---|
| 2,193,399 | 3/1940 | Fisher | 181/160 |
| 2,463,762 | 3/1949 | Giannini | 381/158 |
| 2,921,993 | 1/1960 | Beaverson | 381/159 |
| 3,105,113 | 9/1963 | Olson | 181/145 |
| 3,506,087 | 4/1970 | Ishikawa | 181/199 |
| 3,816,672 | 6/1974 | Gefvert et al. | 381/158 |
| 3,867,996 | 2/1975 | Lou | 181/146 |
| 4,109,983 | 8/1978 | Kinoshita | 181/199 |
| 4,665,549 | 5/1987 | Eriksson et al. | 381/158 |
| 4,690,244 | 9/1987 | Dickie | 181/199 |
| 4,893,695 | 1/1990 | Tamura et al. | 181/146 |

FOREIGN PATENT DOCUMENTS

| | | | |
|---|---|---|---|
| 1487429 | 1/1969 | Fed. Rep. of Germany | 381/158 |
| 364564 | 12/1931 | United Kingdom | 381/155 |
| 434563 | 9/1935 | United Kingdom | 181/151 |
| 483745 | 4/1938 | United Kingdom | 181/151 |

*Primary Examiner*—James L. Dwyer
*Assistant Examiner*—Jason Chan
*Attorney, Agent, or Firm*—Sughrue, Mion, Zinn, Macpeak & Seas

[57] ABSTRACT

A speaker system comprises an acoustic panel. The acoustic panel is constructed of a plurality of thin plate-like sound absorbing panels provided close to the loudspeaker and arranged such that major surfaces thereof are disposed with a predetermined space therebetween so that the front space of the loudspeaker is opened for guiding a sound wave forwardly to radiate along the surface of the panels, while components of the sound wave having a radiation direction oblique to the major central axis of the sound absorbing panels are attenuated due to propagation through the sound absorbing panels. The sound absorbing panels are made of a porous sound absorbing material in which metal powders of Al, Ni, Cu, and others are sintered. In the case where one side of the acoustic panel is opened, it is preferable to provide a sound absorbing material at least at that opening and to further enclose the periphery of the sound absorbing material with a sound insulating material.

13 Claims, 4 Drawing Sheets

SPEAKER SYSTEM HAVING DIRECTIVITY

BACKGROUND OF THE INVENTION

The present invention relates to improvements in a speaker system for generating and allowing selective sound directivity and attenuation in any of four peripheral directions, wherein a loudspeaker produces a difference in sound pressure, i.e., radiates sound, in a selected direction, while providing selected attentuation in any of the four peripheral directions.

Conventionally, an acoustic lens has been used to effect a selected directivity of a loudspeaker. FIG. 11 illustrates an example of one such loudspeaker.

Such a speaker system utilizing an acoustic lens is often used to overcome a deficiency wherein the directivity of the sound pressure radiated from a loudspeaker having a finite diameter becomes sharp with an increase in frequency, thereby causing a strong sound pressure to be concentrated in the front plane. This speaker system operates in a fashion similar to an optical concave lens, i.e., there is a converting of a plane wave of the sound wave into the spherical wave.

More particularly, the acoustic lens applied in a speaker system shown in FIG. 11 operates effectively to alter a shape of the wave front of the sound wave by partly extending the travelling path of the sound wave. This acoustic lens (suitable for analogy to an optical concave lens) is formed of a lamination of perforated thin plates. In this case, if the shape of the wave front at the entrance of the lens is planar (such as in a horn loudspeaker), then the acoustic lens has little or no effect on the shape of the sound wave propagating in the proximity of the central axis, but causes appreciable delay of any sound wave propagating along an axis which is distanced from the central axis since, during propagation, it is required to pass between the laminated plates by detouring. As a result, the wave front is curved close to a spherical wave, thereby resulting in a wider directivity.

In addition to wide directivity embodiments, speaker systems which radiates sound into only a particular narrow area (i.e., having a narrow directivity), but which radiates little or no sound into a remaining area, have been in demand. However, only a special type of loudspeaker such as a parametric loudspeaker using ultrasonics has been successful in obtaining a sufficient directivity.

As one example of a deficient narrow directivity approach, completely reversing the acoustic lens configuration shown in FIG. 11 would cause a spherical wave applied to the input (i.e., wide end) to attempt conversion to a plane wave. Such an arrangement would effect an acoustic "convergent lens" analogous to an optical convex lens, at least for a short distance along the central axis of the reversed acoustic lens. However, although the reversed acoustic lens is effective in converting the spherical wave into the plane wave, the plane wave can be produced only over an area approximating a front projection area of the reverse acoustic (convex) lens, i.e., the sound wave will diffuse in directivity in the vicinity of the convex lens immediately after it passes through the lens, thus failing to obtain the narrow directivity after all.

That is, while a reverse configuration of FIG. 11 is effective in converting the sound wave of the spherical wave into the plane wave or somewhat convergent wave so as to have a certain level of directivity, a desired narrow directivity for extended distances beyond the reversed acoustic lens cannot be implemented. For these reasons, the narrow directivity cannot be obtained by a method which is basically oriented to control the sound travelling path without causing the sound wave to diffuse in directions away from the central axis. It is further difficult to obtain a described directivity in any of loudspeaker, i.e., upper and lower, left and right, as is in the convex lens.

SUMMARY OF THE INVENTION

The present invention is directed to the objective of solving the above-described shortcomings in obtaining a desired directivity with the prior art speaker system.

An object of the invention is to provide a speaker system formed with a simple construction, in which any sound wave having a radiation direction paralleling a central axis and propagating toward the front of the loudspeaker is not attenuated at all, while any sound wave having a radiation direction not paralleling the central axis (i.e., obliquely diffusing and propagating toward the front of the loudspeaker) is subjected to sound transmission loss.

Another object of the invention is to prevent deterioration of the directivity due to the fact that the sound wave is transmitted by conduction through the acoustic panel to the outer surface thereof.

Still another object of the invention is to prevent deterioration in the quality of sound due to interference within the acoustic panel, between the sound wave from the loudspeaker and that from the outside (i.e., external environment) through the aforementioned outer surface of the acoustic panel.

With a speaker system according to the present invention, an acoustic panel is constructed of a plurality of thin plate-like sound absorbing panels provided in close proximity to the loudspeaker with a predetermined space between each and other panels so that a front space of the loudspeaker is opened for guiding the sound wave forwardly to radiate from the front end or surface of the panels. The sound absorbing panels are made of a porous sound absorbing material in which metal powders of Al, Ni, Cu, and others are sintered.

In the case where one side of the acoustic panel is opened, it is preferable to provide a sound absorbing material arrangement according to the present invention at least at this opening and to further enclose the periphery of the sound absorbing material with a sound insulation material.

BRIEF DESCRIPTION OF THE DRAWINGS

Other features and objects of the invention will be more apparent from the following description of preferred embodiments given with reference to the accompanying drawings in which.

DETAILED DESCRIPTION OF THE PREFERRED EMBODIMENTS OF THE INVENTION

Figure 3:
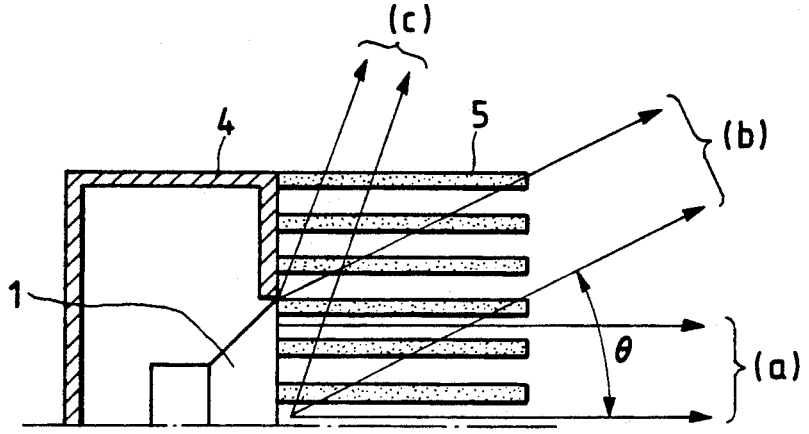
FIG. 3 is an illustrative diagram for illustrating the principle of obtaining directivity according to the invention in the left and right directions with respect to the loudspeaker.

The principle of the present invention will be described in detail with reference to FIG. 3 and FIG. 4 which show only a half portion (with respect to the center line of a loudspeaker) of the loudspeaker arrangement of the present invention.

A loudspeaker 1 is housed in a cabinet 4. A component of the sound wave propagating in a direction of a reference axis or central axis and being radiated from the front of the cabinet 4, and which has a radiation axis coinciding with or paralleling the central axis of the loudspeaker, can pass, as depicted by arrows a, through gaps between sound absorbing panels 5 to reach an external listening point.

In contrast, any component of the sound wave having a radiation direction not paralleling the central axis (i.e., obliquely diffusing and propagating from the front of the cabinet) is attenuated as the sound wave impinges on the sound absorbing panels 5 while propagating in the oblique directions, for example, in the directions of arrows b and c which are deviated from the reference axis. Such sound wave components are subject to sound transmission loss and lose sound pressure when the sound wave passes through the panel 5.

The arrangement of the present invention is advantageous in terms of implementing directivity in that, the attenuation of the sound pressure of the sound wave is greater in the direction of the arrow c than in the direction of the arrow b since the sound wave is absorbed by the panel more often and/or a greater number of times in the former direction than the latter direction. In other words, the attenuation increases with increasing angles $\theta$ relative to the reference axis, thus resulting in a very narrow directivity of the loudspeaker.

The optimum values of space d, length L, and width B of the sound absorbing panel 5 shown in FIGS. 1-2, depend on the frequency range of interest, and are generally determined as follows:

Space d: The space d is 3 to 7 times the thickness t of the sound absorbing panel 5. If a space d is chosen which is too narrow, i.e., resulting in an excessive number of sheets, the sound pressure on the central axis will be decreased and the attenuation effect in the direction of $\theta$ will not be improved.

Length L: The length L is necessary to be such that the sound wave in the direction of $\theta$, where attenuation is preferred, passes through at least two sound absorbing panels 5. However, as is in the case of d mentioned above, an excessive number of sheets will not improve the attenuation effect. Thus, the length L should be selected such that there is a causing of the sound pressure to pass through 3 to 5 of the sound absorbing panels.

Width B: The width B is preferably selected to be 1.5 to 3 times the diameter D of the loudspeaker. A small width causes the sound wave to travel without effective attenuation in the direction of width of the sound absorbing panel 5, thus degrading the attenuation effect particularly at lower frequencies. Thus, the width B is preferably at least greater than the wavelength of the lowest frequency f1 of interest.

Figure 4:
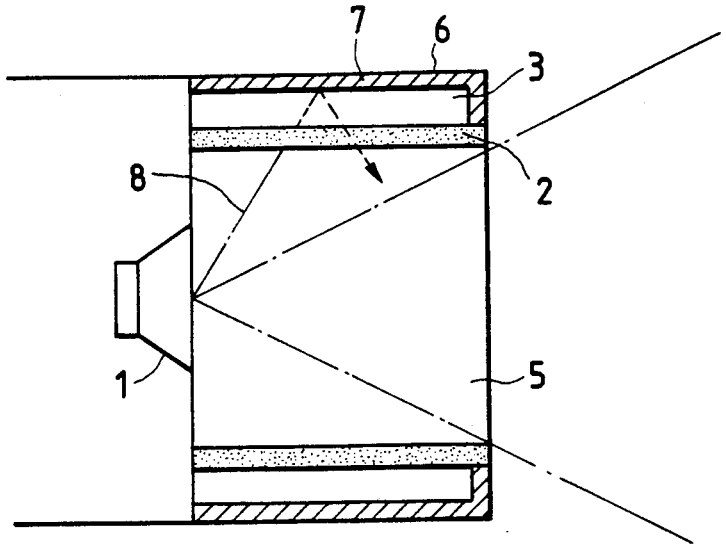
FIG. 4 is an illustrative diagram for showing the principle of obtaining directivity according to the invention in the vertical direction relative to the loudspeaker.

As shown in FIG. 4, of the sound waves radiated from the loudspeaker 1 into the sound absorbing panel 5, a sound wave 8 (which travels in a direction of an angle relative to the central axis) experiences attenuation due to sound transmission loss when it passes through the sound absorbing material 2 of a sound absorber 6, such sound absorber being disposed to abut the end of the sound absorbing panels 5. Further, the sound wave, which travels through an air space behind the sound absorbing material 2 and is reflected by a sound insulation material 7, is given further attenuation when it again travels through the sound absorbing material 2. Thus, the sound wave 8 is attenuated to a sufficiently low level as compared to the initial sound level.

Figure 1:
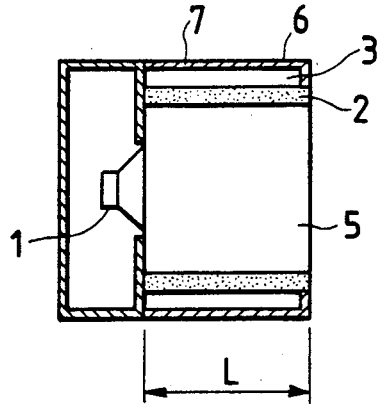
FIG. 1 is a side view of a principle embodiment of the present invention.
Figure 2:
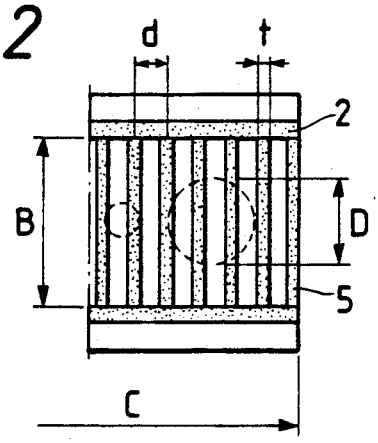
FIG. 2 is an elevational view of FIG. 1.
Figure 5:
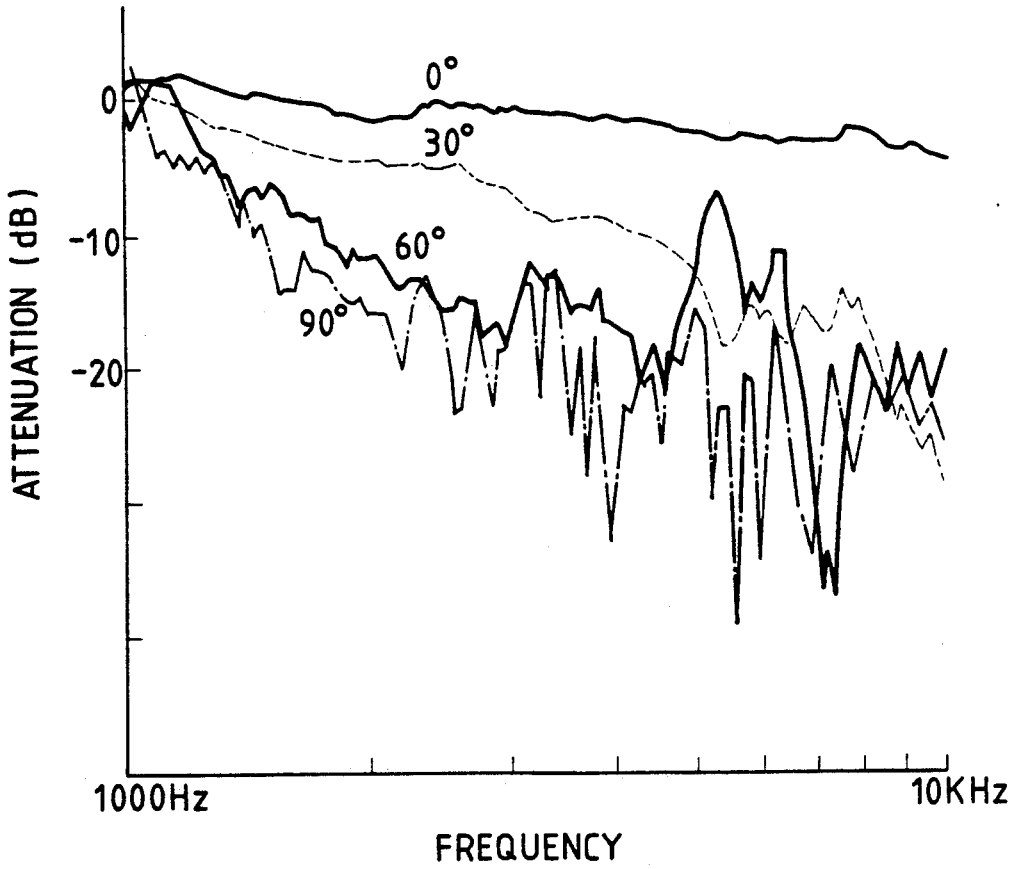
FIG. 5 and FIG. 6 show attenuation versus frequency diagrams in the vertical direction and in the left and right direction, respectively, at angles with respect to the central axis.
Figure 6:
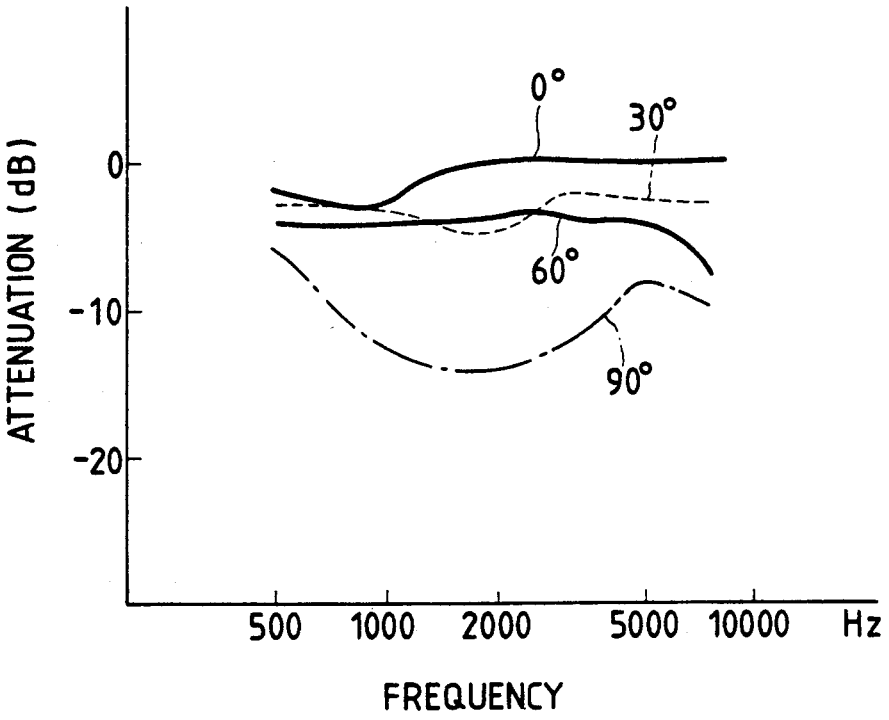

FIGS. 5 and 6 illustrate attenuation characteristics in the vertical direction and in the left and right direction, respectively, of a loudspeaker shown in FIGS. 1 and 2 when the acoustic panel 5 and the sound insulation material 7 having data listed in a Table I are provided.

TABLE I

| | |
|---|---|
| Diameter D of the loudspeaker | 110 mm |
| (Sound absorbing panel 5) | |
| Length, L | 165 mm |
| Width, B | 250 mm |
| Thickness, t | 3 mm |
| Space, d | 18 mm |
| Number of sheets | 24 sheets |
| Sound absorption coefficient, $\alpha$ (1) | 0.91 |
| (Sound insulation material 7) | |
| Length, L | 165 mm |
| Width, C | 450 mm |
| Thickness t | 3 mm |
| Sound absorption coefficient, $\alpha$ (1) | 0.91 |

where (1) represents the sound absorption coefficient in a reverberation room at f=1000 Hz, with the rear air space being 50 mm wide.

In the described embodiment, the sound insulation material and the sound absorption panel 5 are made of a porous sound absorbing material comprising sintered metal powder including, for example, Al, Ni, Cu. More general sound absorption materials such as a porous ceramic sound absorbing material, felt, or other fibrous sound absorbing materials may also be used. In such general material embodiments, at least a portion of a rear surface of the sound absorbing material 2 is required to be closed with wood or plastic sound insulating material 7, which are commonly used as a sound insulation material.

There is a close relation between the depth of the space 3 behind the sound absorbing material 2 and the frequency of the associated sound. The depth necessarily must be large for a good sound absorbing effect in the low frequency range, and must be at least 25 mm wide if the sound absorbing effect is to be obtained for frequencies higher than 1000 Hz.

As a further criteria for directivity, a longer length L is required as a narrower directivity is desired. More particularly, the length L is determined on the basis of the fact that a sound absorbing effect is not present at an angle less than the angle which the central axis makes with a line connecting the center of the loudspeaker 1 and the tip end of the sound absorbing material 2.

The width C may be at least 1.5 times the diameter of the loudspeaker, and is preferably arranged so that the width C coincides with the width B of the sound absorbing panel 5.

In the embodiment described, a symmetrical arrangement of the sound absorbing panels 5 and the sound absorber 6 can cause non-linearity in the frequency response characteristic of the radiated sound at a particular frequency in the direction of the central axis. This is because the sound absorber 6 can act as an acoustic load for the loudspeaker due to the fact that the sound absorber 6 is not perfect in absorbing the sound. An asymmetrical arrangement of the dimension and location of the sound absorber 6 with respect to the loudspeaker is effective to alleviate the non-linearity.

Figure 7:
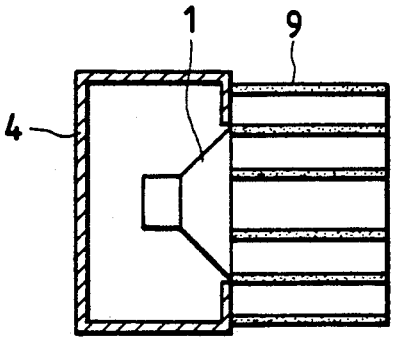
FIG. 7 and FIG. 8 are a side view and a front view, respectively, of another embodiment of the invention.
Figure 8:
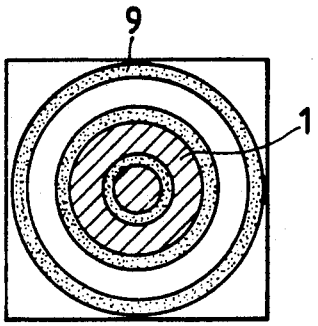
Figure 9:
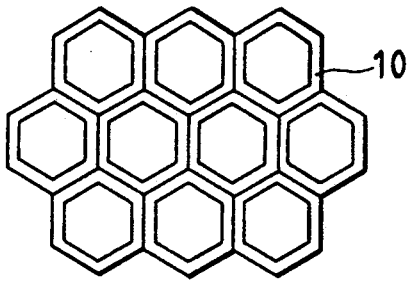
FIG. 9 and FIG. 10 are front views of still other embodiments.

While the embodiment thus far described is directed to a speaker system in which the sound absorbing panels 5 are positioned perpendicularly to the sound absorber 6, a consistent narrow directivity can be obtained both in the horizontal and vertical directions by combining the panels 5 and sound absorber 6 to form concentric sound absorbing panels 9 spaced by a predetermined distance in a bullseye pattern as shown in FIGS. 7 and 8, or by combining a number of hexagonal honeycombs to form another sound absorbing panel 10 such as that shown in FIG. 9.

Figure 10:
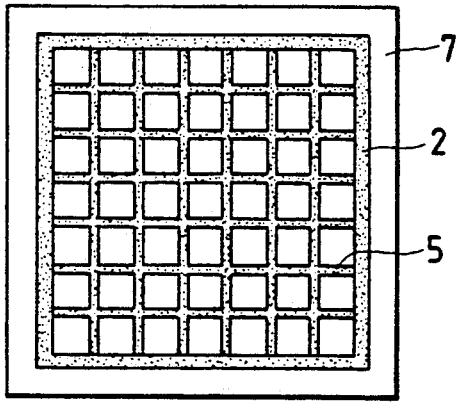
Figure 11:
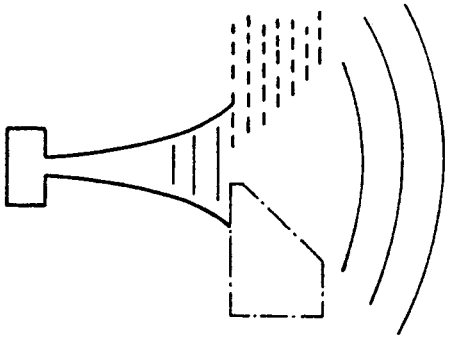
FIG. 11 PRIOR ART
FIG. 11 is a side view of a conventional speaker system.

Further, as shown in FIG. 10, the sound absorbing panels 5 may be combined in such a way that each panel is mutually perpendicular to other panels to form an acoustic panel having a plurality of square openings.

Such an acoustic panel is enclosed along its periphery with the sound absorbing material 2, which itself is covered with the sound insulation material 7. This arrangement also realizes consistent directivity both in the horizontal and vertical directions.

In the present invention, selecting the position of the sound absorbing panels and/or combining the sound absorbing panels with either the sound insulation material or the sound absorbing material permits selected implementation of directivity both in the horizontal and vertical directions.

Further, the sound absorbing material and the sound insulation material perform a dual function of reducing of the sound wave to the outside of the acoustic panel to enhance the directivity of the sound wave in a desired direction, while reducing leakage of outside sound into the acoustic panel to thus avoid deteriorated sound quality due to interference of the sound waves which could result from transmission of environmental sound into the acoustic panel.

By adjusting the length of the sound absorbing panel and the length of the sound absorber, the range of the directivity may be varied at will.

What is claimed is:

1. A speaker system having an acoustic panel means for obtaining directivity of a sound wave radiated from a loudspeaker, said acoustic panel means comprising:

a plurality of sound absorbing panel means positioned adjacent and in front of the loudspeaker, said sound absorbing panel means being arranged such that major surfaces thereof are disposed with a predetermined distance between adjacent sound absorbing panel means, such that components of said sound wave radiated from said loudspeaker and having a radiation direction paralleling a central axis of said sound absorbing panel means are substantially unattenuated, while components having a radiation direction oblique to said central axis are attenuated due to propagation through said sound absorbing panel means, and wherein each of the plurality of sound absorbing panel means has a predetermined thickness, and wherein the predetermined distance is substantially more than 3 times the predetermined thickness of each of the sound absorbing panel means, and less than a diameter of the loudspeaker.

2. A speaker system as claimed in claim 1, wherein said acoustic panel means provides increasing degrees of sound attenuation with respect to radiation direction angles which are increasingly oblique to said central axis.

3. A speaker system as claimed in claim 2, wherein said acoustic panel means further includes sound absorbing enclosure means for enclosing said sound absorbing panel means.

4. A speaker system as claimed in claim 2, wherein said acoustic panel means has a left, right, up and down periphery provided with sound absorbing material means thereover, and sound insulation material means for covering said sound absorbing material means.

5. A speaker system as claimed in claim 4, wherein said sound absorbing panel means are circular such that said acoustic panel means has a bullseye-type arrangement.

6. A speaker system as claimed in claim 5, wherein at least one of said sound absorbing panel means, sound absorbing material means and sound insulation material means are partially composed of sintered metal powder.

7. A speaker system as claimed in claim 4, wherein said plurality of sound absorbing panel means includes first panel means arranged in a first direction, and second panel means arranged in a second direction intersecting said first direction, such that said first and second panel means define cells facing a front of said acoustic panel means and provide sound attenuation in at least two intersecting directions.

8. A speaker system as claimed in claim 7, wherein said first and second panel means intersect in orthogonal directions to define square cells.

9. A speaker system as claimed in claim 8, wherein at least one of said sound absorbing panel means, sound absorbing material means and sound insulation material means are partially composed of sintered metal powder.

10. A speaker system as claimed in claim 7, wherein said first and second panel means intersect in oblique directions to define honeycomb cells.

11. A speaker system as claimed in claim 10, wherein at least one of said sound absorbing panel means, sound absorbing material means and sound insulation material means are partially composed of sintered metal powder.

12. A speaker system as claimed in claim 1, wherein a length of the plurality of sound absorbing panel means is such that the components having a radiation direction oblique to said central axis passes through at least two of the plurality of sound absorbing panel means.

13. A speaker system as claimed in claim 2, wherein a length of the plurality of sound absorbing panel means is such that the components having a radiation direction oblique to said central axis passes through at least two of the plurality of sound absorbing panel means.

* * * * *